United States Patent [19]

McCullough

[11] Patent Number: 4,858,321

[45] Date of Patent: Aug. 22, 1989

[54] SLOTTED DEPTH GAUGE PLATE

[76] Inventor: Timothy J. McCullough, 833 Aurora Rd., Vermilion, Ohio 44089

[21] Appl. No.: 164,015

[22] Filed: Mar. 4, 1988

[51] Int. Cl.[4] ..... B26B 29/00

[52] U.S. Cl. ..... 30/276; 30/293

[58] Field of Search ..... 30/276, 293, 294, 282; 83/881

[56] References Cited

U.S. PATENT DOCUMENTS

| | | | |
|---|---|---|---|
| 3,461,557 | 8/1969 | Behring | 30/276 |
| 3,688,403 | 9/1972 | Bettcher | 30/276 |
| 4,142,291 | 3/1979 | Bettcher | 30/276 |
| 4,166,317 | 9/1979 | Bettcher | 30/276 |
| 4,175,321 | 11/1979 | Bettcher | 30/276 |
| 4,439,924 | 4/1984 | Bettcher | 30/276 |
| 4,492,027 | 1/1983 | Bettcher | 30/276 |
| 4,516,323 | 5/1985 | Bettcher | 30/276 |
| 4,575,937 | 3/1986 | McCullough | 30/276 |

*Primary Examiner*—Douglas D. Watts

*Attorney, Agent, or Firm*—Michael Sand Co.

[57] ABSTRACT

A disc-shaped control plate is mounted within the central opening of a ring-shaped cutting blade of a power driven, hand manipulated trimming knife to control the shape and thickness of strips of material, such as meat, fish, or other pliable or resilient material, severed from a larger body of such material. A slot is formed in a peripheral edge portion of the plate and extends in a plane parallel with and above the plane of the blade cutting edge. The bottom surface of the plate is located below the cutting edge of the blade and presses against the material to compress it as the knife is drawn across the body. Sections of the body extend upwardly into the slot and are severed from the body and assume a shape generally similar to the cross-sectional shape of the slot. An opening in the plate provides a viewing window so the operator can see the previous severed area of the work body. The slot may have various cross-sectional configurations to provide various desired shapes for the final severed strip.

19 Claims, 3 Drawing Sheets

SLOTTED DEPTH GAUGE PLATE

TECHNICAL FIELD

The invention relates to trimming devices and particularly to manually operated power-driven cutting knives used for the quick and easy removal of meat and fish from carcasses and bones. More particularly the invention relates to a depth control gauge adapted to be mounted on a knife for regulating the shape and thickness of the strips of meat or fish severed from a larger body of the material; and in which the shape of the slot can be varied to provide various sizes and cross-sectional configurations of the severed strips.

BACKGROUND ART

Various styles of power-driven meat-cutting tools have been devised wherein a ring blade is rotatably mounted on a holder which in turn is mounted on a manually operated, power-driven handle or handpiece. These tools have been used for some time to facilitate the removal of meat or fish from a carcass, primarily in a trimming operation or for removing the meat remains from the bones. These cutting tools are either electrically or pneumatically driven. Some examples of these prior cutting tools are shown in U.S. Pat. Nos. 3,269,010; 3,852,882; 4,170,063; 4,178,683; 4,198,750 and 4,324,043.

These power driven tools or trimming knives as they are generally referred to in the industry, consist of a tubular handpiece terminating in an arcuate-shaped front end and formed with a hollow bore extending throughout the longitudinal length thereof. The annular blade holder is attached to the arcuate front end of the handpiece with the ring blade being removably mounted thereon by various mounting arrangements. The blade is formed with gear teeth extending around the top thereof, which are in driving engagement with a pinion gear rotatably mounted within the bore adjacent the front end of the handpiece.

In electrically driven knives, a flexible cable, one end of which is connected to a motor located adjacent to the work area, enters the rear of the handle and extends through the bore and terminates in a squared end. The squared end is engaged in a complementary-shaped opening formed in the rear of the pinion gear for rotatably driving the gear. In pneumatically driven knives, a squared shaft end of an air motor is engaged in the rear opening of the pinion gear for driving the gear.

These trimming knives have various size diameter blade holders and cutting blades mounted thereon depending upon the particular trimming operation for which the knives are to be used.

During the trimming operation, an operator draws the knife across the work piece and sections or slices of meat or fish are cut from the main body or carcass. The severed sections pass through the central opening of the blade housing and blade. It has been found that in using such knives, it is difficult to control the depth of the cut of the meat being removed. This results in increased cutting strokes or passes of the knife over the carcass to remove certain portions of the meat, such as in fatty areas, in contrast to other areas where too much lean meat is removed by a singe movement of the knife across the carcass. This adversely affects the appearance of the trimmed surface of the meat and removes unwanted meat from the main body reducing the yield of higher quality, more expensive lean meat.

Many of these problems have been eliminated by prior art depth control gauges for trimming knives, primarily used for trimming meat, such as shown in U.S. Pat. Nos. 3,461,557, 3,688,403 and 4,575,937. Although these prior art depth control gauges do perform satisfactorily for certain trimming operations, they do not permit the operator to maintain a constant size and shape of the strip of material severed from the work body.

It is desirable, when trimming certain types of meat and fish, that the slices have a certain configuration both for aesthetic purposes and for enhanced trimming results. Thus, for certain trimming functions, a particular size and cross-sectional configuration of the strip is desired throughout the trimming operation to provide a plurality of similar strips which can be sold as end products, wherein the shape is constant and aesthetically pleasing to the final consumer.

These prior depth gauge constructions do not permit such uniformity and constant cross-sectional configuration of the severed slice or strip by the use of these known depth gauges due to the unrestrained and undefined area between the edge of the gauge plate and the rotating knife blade.

Another feature of these prior depth gauge plates is that the entire outer periphery of the cutting edge of the blade is exposed for use when cutting the meat or fish. Again, this increases the difficulty of providing a uniform severed slice time after time as the knife is manually passed across the main meat or fish carcass.

There is no known depth control gauge for trimming knives, primarily used for trimming meat or fish, of which I am aware which enables both the depth and cross-sectional configuration of the strip severed from the main work body to be uniform for each trimming movement or path of the knife across the work body.

DISCLOSURE OF THE INVENTION

Objectives of the invention include providing a depth control gauge for a trimming knife of the type having an annular blade holder mounted on the front end of a handpiece for rotatably mounting a ring blade thereon; in which the depth control gauge is mounted on the front end of the handpiece axially above the blade holder and blade; and in which the gauge is mounted within the interior of the ring blade and includes a rigid disc-shaped plate which is pressed against the work product as the blade is drawn thereacross to sever portion of the product from the main body.

Another objective is to provide such an improved depth gauge plate in which the disc-shaped plate is located within the periphery of the cutting blade and below the plane of the blade edge; in which a slot is formed in the peripheral edge of the plate and extends radially inwardly; and in which the plane of the surface of the slot is generally parallel with and above the plane of the blade cutting edge.

A further objective of the invention is to provide such a depth gauge plate in which the slot may have various cross-sectional configurations whereby the strip of material severed from the main work body passes through the slot when severed and assumes the cross-sectional configuration of the slot; and in which various plates may be provided, each having a different cross-sectional configured slot, to provide various cross-sectional configurations to the severed product.

Another objective of the invention is to provide such a depth gauge plate which can be adjustably mounted on the handpiece for axial adjustment with respect to the cutting blade whereby the thickness of the severed strip can be varied while retaining the same general cross-sectional configuration thereof.

A still further objective of the invention is to provide such an improved depth gauge plate in which an elongated, oval-shaped opening is formed in the plate in combination with indicating markings to enable the operator to visually view the previous area of the work piece from which the severed strip was taken, to provide an alignment guide for severing the next strip of material from the work piece directly adjacent to or slightly overlapping the previously severed area.

Still another objective of the invention is to provide such a gauge plate which is prevented from rotation within the rotating blade by a stabilizing pin extending downwardly from the plate mounting bracket; and in which the plate can be easily attached to the mounting bracket by a threaded connection to permit rapid and easy removal and replacement of the disc from the handpiece for maintenance purposes, and to provide a plurality of replaceable plates having different configured slots to vary the configuration of the severed strip of material from the work piece.

Another objective of the invention is to provide such a gauge plate in which the bottom surface thereof and, in particular, the peripheral edge thereof extends below the plane of the blade cutting edge, exposing only a relatively small arcuate section of the cutting blade which engages the work piece which reduces the area of exposed blade to reduce the possibility of injury to the operator.

A still further objective of the invention is to provide such a gauge plate with an outer diameter nearly equal to the inner diameter of the cutting blade thereby preventing the passage of any work piece particles from passing therebetween except in the area of the slot formed in the gauge plate.

Another objective of the invention is to provide such a depth gauge plate in which the plate is formed of a relatively stiff plastic material, which can be used for trimming portions of any resilient product such as meat and fish, and in addition may be used for trimming other types of products, such as foam rubber or the like, so long as the product is resilient enough to be pressed downwardly by the bottom surface of the blade permitting only the desired section which is to be severed therefrom to expand upwardly into the slotted area.

Another objective is to provide such a slotted depth gauge plate which achieves these desired results in an extremely efficient manner, which eliminates difficulties existing in the art, which solves problems, satisfies needs and obtains new results in the art, and which enables an operator to quickly, easily and efficiently use the depth gauge without requiring any appreciable skill for doing the same, other than those skills previously obtained in the usual trimming manipulation of the knife on which the gauge plate is mounted.

These objectives and advantages are obtained by the improved depth gauge plate of the invention, the general nature of which may be stated as being used for a trimming knife of the type having a ring-shaped blade holder mounted on the front end of a handpiece and having a ring-shaped cutting blade with a central opening being rotatably mounted on the blade holder; said depth gauge plate including plate means disposed within the central opening of the cutting blade, said plate means having a peripheral edge, and slot means formed in same edge for passing a section of meat severed from a larger body of meat whereby the cross-sectional configuration of the severed section corresponds to the cross-sectional configuration of the slot means.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
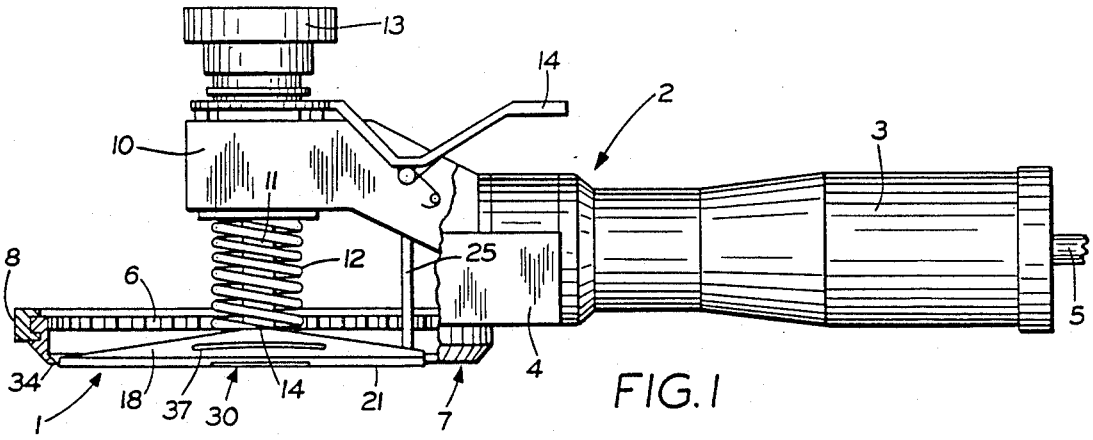
FIG. 1 is a side elevational view of the slotted depth gauge plate of the invention adjustably mounted on a usual trimming knife, with portions of the blade broken away and in section.

The depth control plate of the invention is indicated generally at 1, and is shown particularly in FIGS. 2–9, and is shown in FIG. 1 mounted on a usual trimming knife indicated generally at 2. Knife 2 is illustrated as being a usual electric-driven meat trimming knife having a handle 3 extending outwardly rearwardly from an arcuate-shaped blade attachment front end portion 4. Knife 2 is adapted to be connected to an electric motor by a flexible drive cable 5. The electric motor for driving cable 5 is usually supported by a hanger mounted closely adjacent a work table on which the meat trimming operation is being performed. If desired, knife 2 may be pneumatically driven having an air motor mounted within the handle. Knife 2, as shown in FIG. 1, is of the type shown in my earlier U.S. Pat. No. 4,575,937 the details of which are incorporated herein.

A rotatably mounted pinion gear (not shown) is mounted within the front end of the handpiece and is driven by cable 5, or a pneumatic motor. The pinion gear meshingly engages gear teeth 6 formed about the peripheral top surface of a ring-shaped cutting blade, indicated generally at 7. Blade 7 is rotatably mounted in a ring-shaped blade housing 8, which is mounted on the arcuate-shaped front end 4 in a usual manner. Knife 2 also may be of the type as shown in U.S. Pat. Nos. 3,024,532; 3,269,010; 3,852,882; 4,324,043 and 4,363,170 without effecting the concept of the invention.

In the particular embodiment shown in FIG. 1, plate 1 is adjustably mounted on an outwardly extending mounting bracket or body 10 which is attached to front end 4 of the blade holder. A shaft 11 extends axially downwardly from bracket 10 and is spring biased in a downward direction by a coil spring 12. Manual rotation of an upper adjustment nut 13 will raise and lower plate 1 with respect to trimming blade 7. Again, the particular mounting arrangement of plate 1 and its adjustment with respect to mounting bracket 10 can be the same as described in U.S. Pat. No. 4,575,937. A manually operated control lever 14 also may be mounted on body 10 and engageable with plate mounting shaft 11 for raising and lowering the plate from its operating position. The lower end of shaft 11 (FIG. 11) is threaded at 14 and is engaged in an internally threaded opening 15 formed in the center of plate 1 for mounting plate 1 thereon.

In accordance with the invention, plate 1 is formed of a rigid material, preferably plastic, so as to be easily cleaned and maintained in a sanitary condition, and is of the type of plastic approved by government regulations for use when contacting food products for human consumption.

As shown in FIGS. 6–9, plate 1 is a one-piece member and includes a main, generally disc-shaped body 17 having a conical top surface 18 and an outer, slightly angled axially extending peripheral edge 19. Edge 19 is joined with a conical bottom surface 20 by a generally horizontal annular flat peripheral area 21. Conical bottom surface 20 terminates in an annular inner area 22 having an annular boss 23 projecting downwardly therefrom in which threaded opening 15 is formed.

Figure 2:
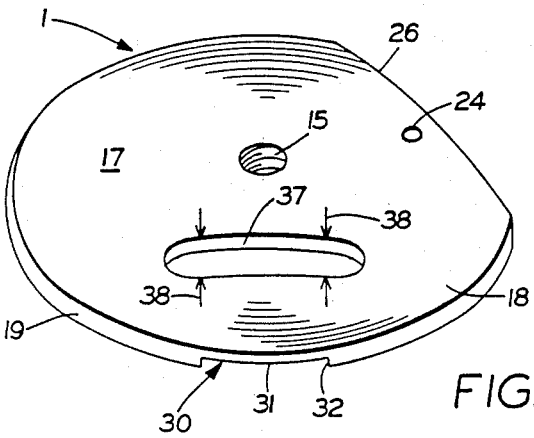
FIG. 2 is an enlarged perspective view of the slotted depth gauge plate of the invention removed from the trimming knife of FIG. 1.

A hole 24 preferably is formed in plate 1 for receiving a stabilizer pin 25 (FIG. 1) to prevent rotation of the plate with respect to handle 3. A section of plate 1 also may have a straight or chordal edge 26 formed thereon as shown in FIGS. 2–4.

Figure 4:
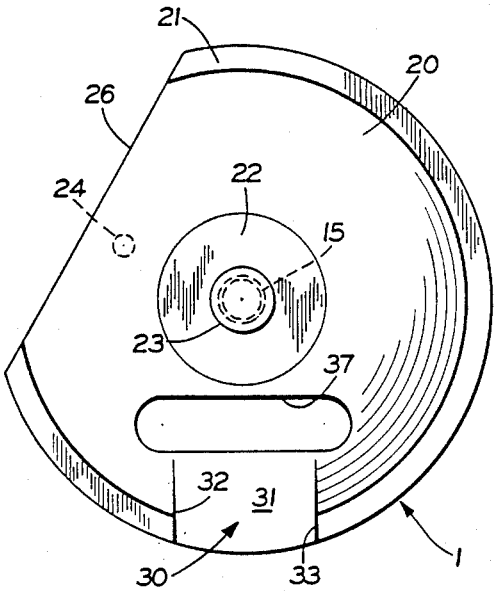
FIG. 4 is a bottom plan view of the gauge plate of FIGS. 2 and 3.
Figure 5:
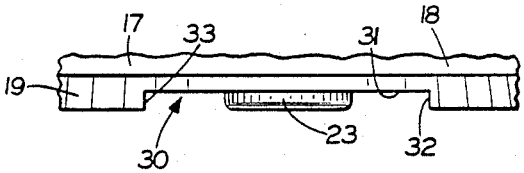
FIG. 5 is an enlarged fragmentary end elevational view looking in the direction of arrows 5—5, FIG. 3.
Figure 6:
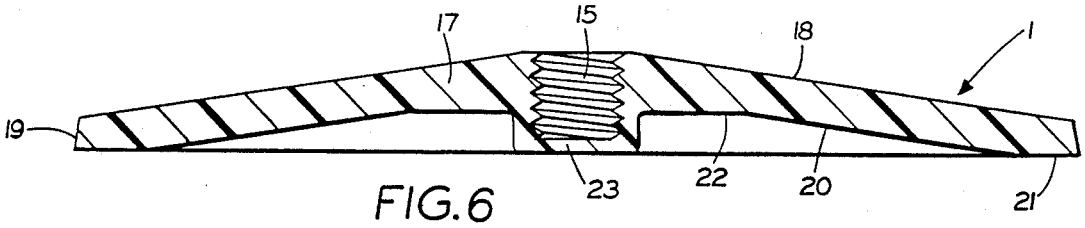
FIG. 6 is an enlarged sectional view taken on line 6—6, FIG. 3.
Figure 7:
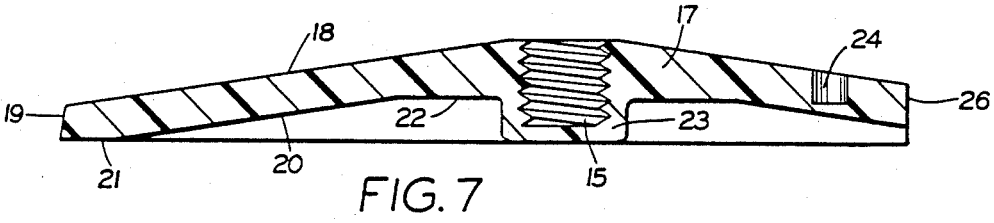
FIG. 7 is an enlarged sectional view taken on line 7—7, FIG. 3.
Figure 8:
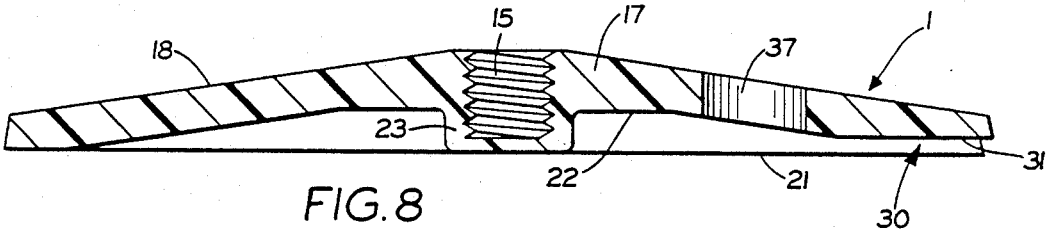
FIG. 8 is an enlarged sectional view taken on line 8—8, FIG. 3.
Figure 9:
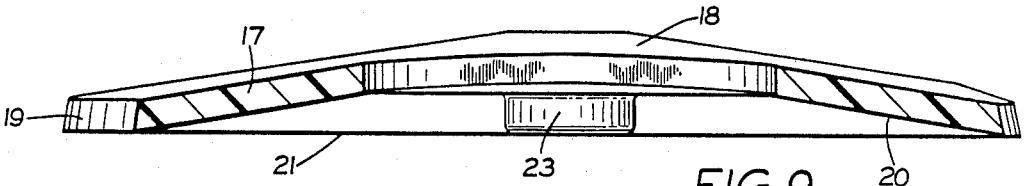
FIG. 9 is an enlarged sectional view taken on line 9—9, FIG. 3.
Figure 10:
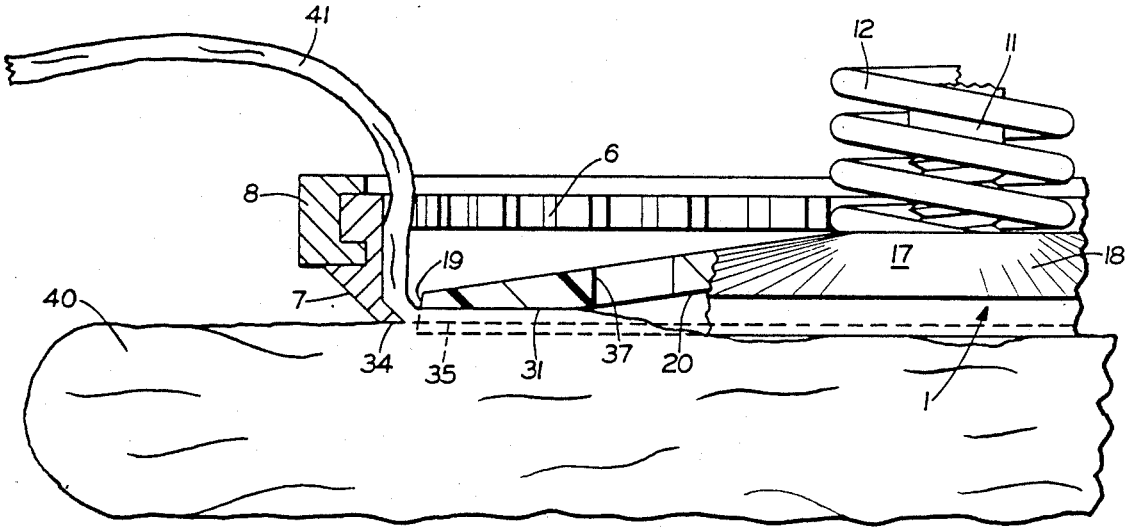
FIG. 10 is an enlarged generally diagrammatic sectional view showing the gauge plate in operation severing a strip of material from a main work body.
Figure 11:
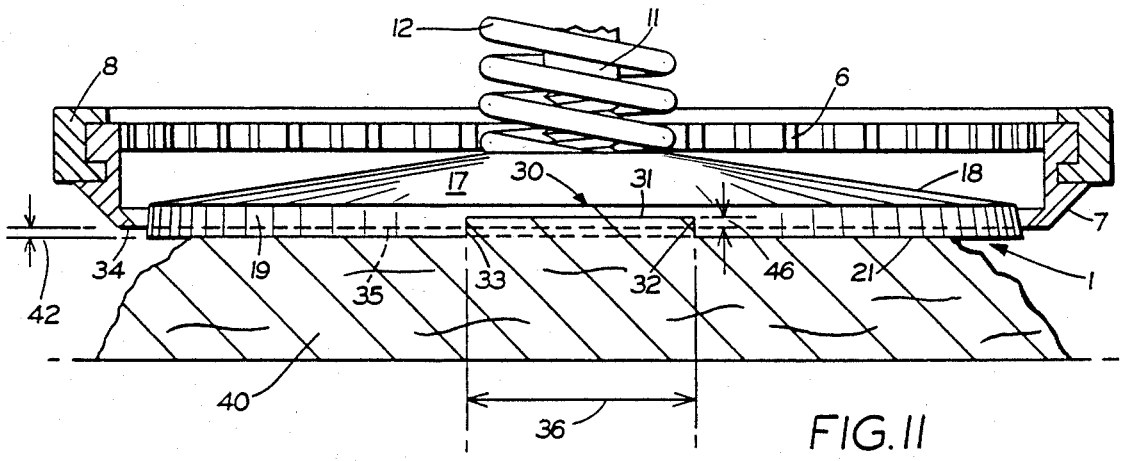
FIG. 11 is a reduced sectional diagrammatic view similar to FIG. 10, showing the use of the gauge plate in a trimming operation.

In accordance with the main feature of the invention, a slot, indicated generally at 30 (FIGS. 4 and 5), is formed in peripheral edge 19 and extends through annular flat area 21 and partially through conical bottom surface 20 of plate 1 as shown in FIG. 8. Slot 30 includes a top surface 31 and a pair of side surfaces 32 and 33 (FIG. 5). Surfaces 31, 32 and 33 provide the cross-sectional configuration of the slot as shown particularly in FIGS. 2, 5 and 11. The plane of top surface 31 as shown in FIGS. 10 and 11, preferably is parallel with and is located above the plane of the blade cutting edge 34, which plane is indicated at 35. Also as shown in FIG. 11, the plane of slot surface 31 will be above plane 35 of cutting edge 34 and above the plane defined by the peripheral outer annular flat area 21 (FIG. 8) of the plate.

Figure 3:
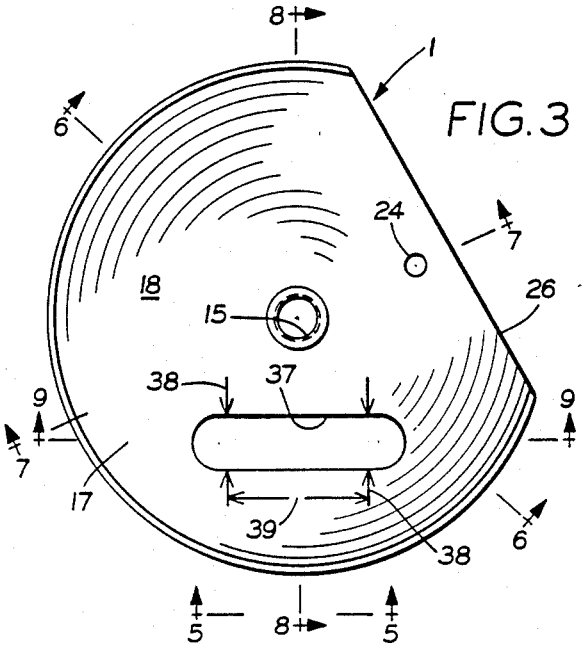
FIG. 3 is a top plan view of the gauge plate of FIG. 2.

An elongated, oval-shaped opening or window 37 is formed in and extends through plate 1 (FIG. 3). Two pairs of spaced indicating markers 38 are stamped or etched in top surface 18 of the plate adjacent opening 37. The separation between the markers, indicated at 39, is equal to the width of slot 30, indicated at 36 (FIG. 11). Markers 38, in combination with window 37, provide the operator of the knife with a view of the area from which the previous strip of material was severed. This enables the operator to align the next cut with the previously cut area. Markers 38 provide the operator with an accurate indication of the size or width of the slice of material to be severed from the main work body or work piece, which is indicated at 40 and shown in FIGS. 10 and 11, during the next pass of the knife over the work piece.

The operation and manner of use of improved slotted gauge plate 1 is shown diagrammatically in FIGS. 10 and 11. An operator will manually adjust the position of the control plate with respect to the cutting edge 34 of blade 7 whereby the plane of the bottom surface of gauge plate 1, and in particular the plane defined by annular flat area 21, is beneath plane 35 of the cutting edge as shown in FIG. 11, a distance indicated at 42. Top surface 31 of slot 30 will be generally equal to or above plane 35 of cutting edge 34. This spacing, indicated at 46 in FIG. 11, will determine the thickness of a material strip 41 severed from work piece 40. Also the width of strip 41 will be generally equal to the width of slot 31, which is the distance 36 between edges 32 and 33. The configuration of the strips severed from work piece 40 in cross-section, will approximate the cross-sectional configuration of the slot. Thus, for the slot shown in FIGS. 2 and 5, strip 41 will be generally rectangularly shaped in cross section.

The operator upon moving the knife across the meat, fish or other type of work piece, will depress the product by the sliding contact with the bottom surface of plate 1. The uncompressed product adjacent slot 30 will fill the slot area whereby the cutting blade will sever strip 41 from the main body of the work piece equal to the thickness and shape of slot 30. The outer diameter of plate 1 preferably is generally equal to slightly smaller than the inner diameter of cutting edge 34 of blade 7 as shown in FIG. 10, which prevents any product from moving upwardly therebetween for engagement with the rotating knife blade.

Figure 12:
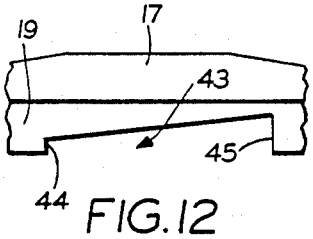
FIGS. 12, 13 and 14 are fragmentary end elevational views, showing three different slot cross-sectional configurations of the gauge plate of the invention.
Figure 13:
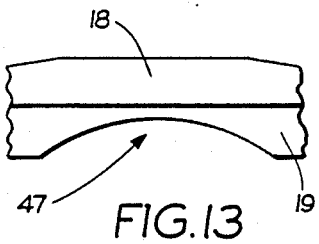
Figure 14:
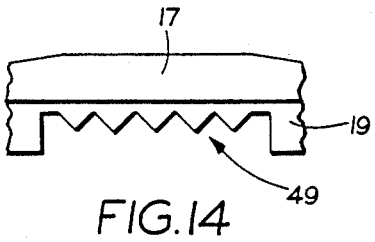

Various cross-sectional configurations including widths and depths, may be achieved by changing the configuration of the plate slot. Three examples of various configurations are shown in FIGS. 12–14. Slot 43 of FIG. 12 will provide a severed strip in which one edge is thicker than the opposite edge due to the difference in lengths of slot edges 44 and 45.

The particular slot configuration shown in FIG. 13 and indicated at 47, will provide a strip having a generally semi-circular or convex outer configuration which is desirable for certain meat and fish products. This provides both a uniformly sized severed strip of material, in addition to one which is aesthetically pleasing for certain applications.

The particular slot configuration 49 of FIG. 14, shows a saw-tooth design and will provide a severed strip of material in which the top surface thereof will be a series of V-shaped grooves and ridges. Again, this provides a severed product having certain aesthetic characteristics which may be desired for certain applications.

FIGS. 12–14 represent merely three different slot configurations, in addition to the rectangular-shaped slot 30 of FIGS. 1–10, which configurations will be imparted to the final strips severed from work piece 40. However the invention need not be limited to these specific slot configurations which are shown for illustration purposes only.

Figure 15:
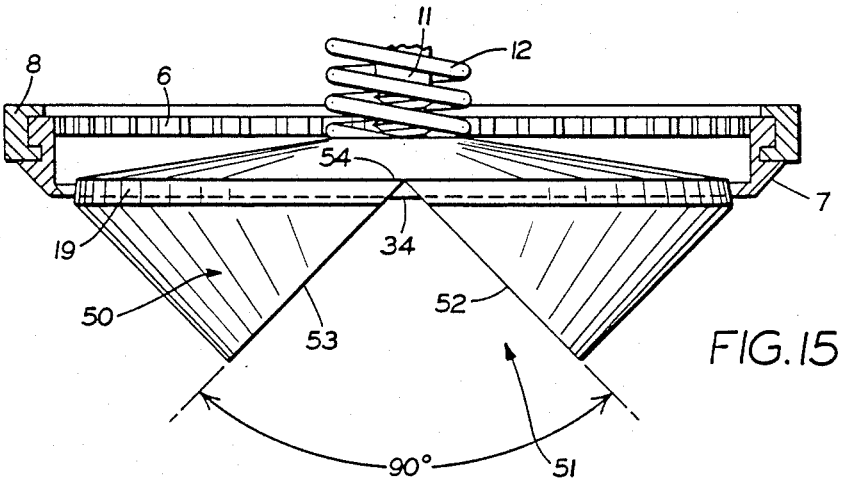
FIG. 15 is a partial sectional view showing another form of the gauge plate for carrying out a corner trimming operation.
Figure 16:
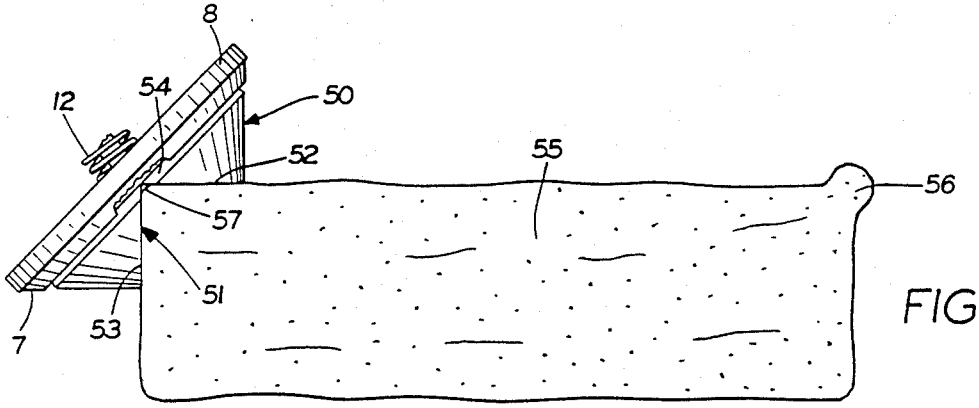
FIG. 16 is a diagrammatic view showing the use of the gauge plate of FIG. 15 for trimming the corners of a block of resilient material.

Another embodiment of the improved gauge plate is shown in FIGS. 15 and 16. In this embodiment a modified plate 50 has a V-shaped slot 51 formed by perpendicularly mating walls 52 and 53 which join at an apex 54. The manner of mounting plate 50 on a trimming knife is the same as that shown above for plate 1.

FIG. 16 shows a type of application in which modified plate 50 may be used, that is, trimming the edges of a block of foam or resilient material 55. Modified plate 50 may be moved along the edge 56 thereof, which is formed unevenly in the molding operation, to provide a right angle edge 57 as shown at the left-hand side thereof. Again, material 55 has sufficient resiliency whereby the bottom surface or the side edges of the plate will compress the material of the main body sufficiently so that the uncompressed material will move into the slot area for subsequent severing from the main body by the rotating blade.

The above described procedure is performed generally instantaneously by the operator during the trimming operation without difficulty and without requiring any additional skill on the operator's part, and without materially changing or modifying the usual trimming procedure. Therefore, improved gauge plate 1 provides a device adapted to be attached to a usual trimming knife which enables an operator to have a preset control gauge for regulating the thickness and cross-sectional configuration of a strip of material trimmed from a main work body, such as meat or fish, which enables the operator to repeatedly remove strips of material which are similar in shape and configuration without requiring an excessive amount of skill and manual dexterity.

Gauge plate 1 preferably is formed of plastic enabling the device to be maintained in a sanitary condition which is required for products coming into contact with meat, fish or other products processed for human consumption.

Another advantage is that the depth gauge plate can be mounted on and removed from existing styles of trimming knife handpieces by usual attachment bolts or other mounting arrangements, and when desired can be removed from the knife permitting the knife to be used for usual trimming operations without the depth control plate as a part thereof.

Accordingly, the improved slotted depth gauge plate is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved slotted depth gauge plate is constructed and used, the characteristics of the construction, and the advantageous, new and useful results obtained; the new and useful structures, devices, elements, arrangements, parts, and combinations, are set forth in the appended claims.

What is claimed is:

1. In a trimming device adapted to be manually held and manipulated for cutting a strip-like section or slice from a work body by drawing the tool thereacross, said device including an annular support means lying substantially in a flat plane and supporting an annular cutting blade mounted for rotation in the direction of its own circumference, a handle means rigid with said support means, said support means and blade extending in a continuous relation around, and lying outside of, a common axial opening through which the severed section passes during the cutting thereof from said work body as the blade rotates and the support means is manually drawn across said body substantially in said plane to sever said section therefrom; the improvement comprising a depth control plate mounted on said device and disposed within said common axial opening, said plate being a generally rigid disc-shaped member having a curved peripheral edge portion joining top and bottom surfaces wherein said bottom surface is located at least adjacent to or below the plane of the blade cutting edge so that it presses against the work body as the blade is drawn across said body; and a slot formed in the edge portion of the plate whereby sections of the work body extend into the slot and are severed from the work body and assume a shape generally similar to the cross sectional shape of said slot.

2. The trimmer defined in claim 1 in which the plate is adjustably mounted on the handle for movement toward and away from the cutting blade edge in the direction of the axis of the axial opening to vary the distance between the slot means and said cutting edge.

3. The trimmer defined in claim 1 in which a stabilizer pin extends between the plate and handle support means to prevent rotation of said plate.

4. The trimmer defined in claim 1 in which the slot has a rectangular cross-sectional configuration.

5. The trimmer defined in claim 1 in which the slot has a saw-toothed cross-sectional configuration.

6. The trimmer defined in claim 1 in which the slot has a convex cross-sectional configuration.

7. The trimmer defined in claim 1 in which the slot has a top surface which lies in a plane generally parallel to the plane of the cutting blade edge.

8. The trimmer defined in claim 1 in which the plate is formed of plastic.

9. The trimmer defined in claim 1 in which the top surface of the plate is generally conically shaped.

10. The trimmer defined in claim 1 in which a generally axially extending opening is formed in the plate and extends between the top and bottom surfaces providing a window for viewing the work body adjacent the slot.

11. The trimmer defined in claim 10 in which the widow opening has a greater width than the width of the slot.

12. The trimmer defined in claim 1 in which the curved peripheral edge of the plate is connected by a straight chordal edge of the plate.

13. The trimmer defined in claim 1 in which the diameter of the curved peripheral edge is generally equal to the interior diameter of the blade restricting passage of the work body therebetween.

14. An improved depth control gauge for use with a knife for trimming meat, fish or similar product and being of the type having a ring-shaped blade holder mounted on the front end of a handpiece, with a ring-shaped cutting blade having a central opening being rotatably mounted on the blade holder; said depth control gauge including a plate disposed within the central opening of the cutting blade, said plate having a peripheral edge and slot means formed in said edge for passing a section of product severed from a larger body of said product through the slot means whereby the cross-sectional configuration of the severed section corresponds to the cross-sectional configuration of the slot means.

15. The depth control gauge defined in claim 14 in which the slot means includes a smooth top wall; and in which the plane of said top wall is parallel with and spaced above the plane of the cutting blade.

16. The depth control gauge defined in claim 14 in which the plate is a generally disc-shaped rigid member; in which the major portion of the peripheral edge of said plate is circular; and in which a bottom surface of said peripheral edge is located below the plane of the cutting blade.

17. The depth control gauge defined in claim 16 in which mounting means movably mount the plate on the handpiece for axial movement with respect to the ring-shaped blade opening.

18. The depth control gauge as defined in claim 14 in which the circular portion of the peripheral edge of the plate includes a generally flat annular radially inwardly extending portion.

19. A plate for mounting within the periphery of a ring shaped cutting blade of a power driven trimming knife for severing strips of material from a larger body of resilient material, said plate being formed of a generally rigid material and having a bottom surface and a peripheral edge, and a radially inwardly extending slot formed in said bottom surface and edge providing a predetermined cross-sectional configuration to the slot so that as the knife is moved manually across the body of material, the material is compressed by the bottom surface of the plate except for the area of the slot whereby the material extends into said slot and is severed by the cutting blade and assumes a shape similar to the cross-sectional shape of said slot.

* * * * *